US006878245B2

(12) United States Patent
Gandikota et al.

(10) Patent No.: US 6,878,245 B2
(45) Date of Patent: Apr. 12, 2005

(54) METHOD AND APPARATUS FOR REDUCING ORGANIC DEPLETION DURING NON-PROCESSING TIME PERIODS

(75) Inventors: Srinivas Gandikota, Santa Clara, CA (US); Chris R. McGuirk, San Jose, CA (US); Deenesh Padhi, San Jose, CA (US); Sivakami Ramanathan, Fremont, CA (US); Muhammad Atif Malik, Santa Clara, CA (US); Girish A. Dixit, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/085,338

(22) Filed: Feb. 27, 2002

(65) Prior Publication Data

US 2003/0159936 A1 Aug. 28, 2003

(51) Int. Cl.[7] ..... C25D 17/00; C25D 21/00

(52) U.S. Cl. ..... 204/275.1; 204/224 R; 204/237; 205/101; 205/148

(58) Field of Search ..... 204/237, 238, 204/245, 263, 264, 275.1, 276; 205/99, 101, 123, 148

(56) References Cited

U.S. PATENT DOCUMENTS

| | | | |
|---|---|---|---|
| 4,051,001 A | 9/1977 | Inoue et al. | 204/151 |
| 4,132,605 A | 1/1979 | Tench et al. | 204/1 T |
| 4,290,856 A | 9/1981 | Inoue | 204/4 |

(Continued)

OTHER PUBLICATIONS

F. A. Lowenheim, Electroplating, McGraw–Hill Book Company, New York, 1978, pp. 152–155.*

*Primary Examiner*—Roy King
*Assistant Examiner*—William T. Leader
(74) *Attorney, Agent, or Firm*—Moser, Patterson & Sheridan

(57) ABSTRACT

Embodiments of the invention generally provide an apparatus and method for replenishing organic molecules in an electroplating bath. The replenishment process of the present invention may occur on a real-time basis, and therefore, the concentration of organics minimally varies from desired concentration levels. The replenishment method generally includes conducting pre-processing depletion measurements in order to determine organic depletion rates per current density applied in the electroplating system. Once the organic depletion rates per current density are determined, these depletion rates may be applied to an electroplating processing recipe to calculate the volume of organic depletion per recipe step. The calculated volume of organic depletion per recipe step may then be used to determine the volume of organic molecule replenishment per unit of time that is required per recipe step in order to maintain a desired concentration of organics in the plating solution. The calculated replenishment volume may then be added to the processing recipe so that the replenishment process may occur at real-time during processing periods. The apparatus generally includes a selectively actuated valve in communicaiton with a fluid delivery line, wherein the valve is configured to fluidly isolate a plating cell during a non-processing time period. The valve may be controlled by a system controller, and thus, the fluid level in the cell may be controlled during a non-processing time period.

17 Claims, 7 Drawing Sheets

U.S. PATENT DOCUMENTS

| | | | | | |
|---|---|---|---|---|---|
| 4,468,305 | A | | 8/1984 | Hillis | 204/130 |
| 4,469,564 | A | | 9/1984 | Okinaka et al. | 204/15 |
| 4,479,852 | A | | 10/1984 | Bindra et al. | 204/1 T |
| 4,511,443 | A | | 4/1985 | Goffman et al. | 204/108 |
| 4,699,081 | A | | 10/1987 | Mack | 118/691 |
| 4,834,842 | A | | 5/1989 | Langner et al. | 204/1 T |
| 5,935,402 | A | | 8/1999 | Fanti | 205/101 |
| 6,024,856 | A | | 2/2000 | Haydu et al. | 205/84 |
| 6,103,085 | A | * | 8/2000 | Woo et al. | 205/143 |
| 6,113,769 | A | * | 9/2000 | Uzoh et al. | 205/101 |
| 6,143,155 | A | * | 11/2000 | Adams et al. | 205/87 |
| 6,280,602 | B1 | | 8/2001 | Robertson | 205/775 |
| 6,332,963 | B1 | * | 12/2001 | Sakaki et al. | 204/266 |
| 6,458,262 | B1 | | 10/2002 | Reid | 205/82 |
| 6,517,894 | B1 | * | 2/2003 | Hongo et al. | 427/97 |
| 6,527,920 | B1 | | 3/2003 | Mayer et al. | 204/237 |
| 6,569,299 | B1 | * | 5/2003 | Reid et al. | 204/282 |

* cited by examiner

*FIG. 7*

(1) Test Run

| A/cm $^2$ | Duration | Depletion | Calculated Depletion/Unit Time |
|---|---|---|---|
| 10 | 20 | 40 | 2.00 |
| 11 | 20 | 43 | 2.15 |
| 12 | 20 | 46 | 2.30 |
| 13 | 20 | 48 | 2.40 |
| 14 | 20 | 50 | 2.50 |
| 15 | 20 | 51 | 2.55 |

(2) Calculate

Step A (5 units of Time) (2 volumes of depletion/unit of time) = 10 units of Organic Step B (10 units of Time) (2.5 volumes of depletion/unit of time) = 25 units of Organic Step C (5 units of Time) (2.3 volumes of depletion/unit of time) = 11.5 units of Organic Step D (5 units of Time) (2 volumes of depletion/unit of time) = 10 units of Organic (3) Modify Recipe

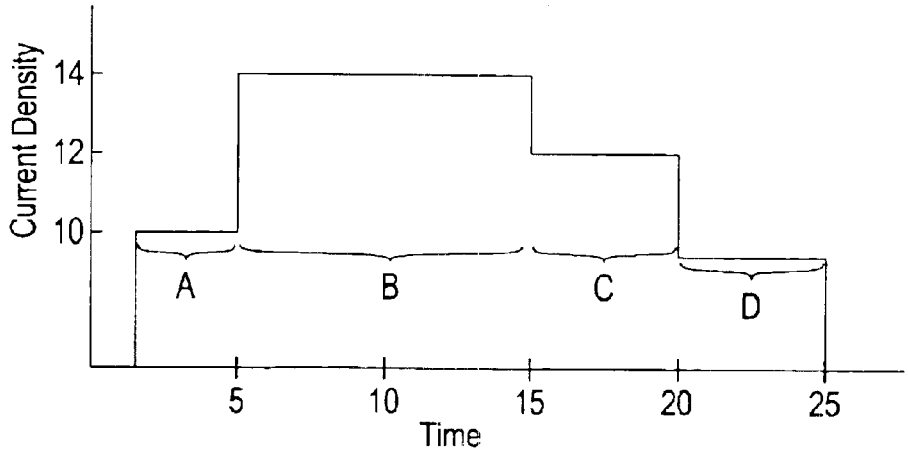

METHOD AND APPARATUS FOR REDUCING ORGANIC DEPLETION DURING NON-PROCESSING TIME PERIODS

BACKGROUND OF THE INVENTION

1. Field of the Invention

The present invention generally relates to reducing depleted organics in electroplating baths.

2. Description of the Related Art

Sub-quarter micron multilevel metallization is a key technology for the next generation of very large scale integration (VLSI) and ultra large scale integration (ULSI). The multilevel interconnects that lie at the heart of these integration technologies possess high aspect ratio features, including contacts, vias, lines, plugs, and other features. Therefore, reliable formation of these features is critical to the success of VLSI and ULSI, as well as to the continued effort to increase integrated circuit density, quality, and reliability on individual substrates. As such, there is a substantial amount of ongoing effort being directed to improving the formation of void-free sub-quarter micron features having high aspect ratios, i.e., features having a height to width ratio of about 4:1 or greater.

Elemental aluminum (Al) and aluminum alloys have conventionally been used as conductive materials to form lines, plugs, and other features in integrated circuit semiconductor processing techniques, as a result of aluminum's low resistivity, superior adhesion to silicon dioxide ($SiO_2$) substrates, ease of patterning, desirable electromigration characteristics, and relatively high purity available at moderate costs. However, as circuit densities increase and the size of conductive features therein decreases, conductive materials having a lower resistivity than aluminum may be desirable. Therefore, copper and copper alloys are becoming choice metals for filling sub-quarter micron and smaller high aspect ratio interconnect features in integrated circuits, as copper and copper alloys have a lower resistivity than aluminum, and therefore, generate better resistance/capacitance time delay characteristics. Additionally, copper provides improved electromigration characteristics over aluminum.

However, a challenge with using copper in integrated circuit fabrication is that copper is not easily deposited into high aspect ratio features with conventional semiconductor processing techniques. For example, physical vapor deposition (PVD) techniques may be used to deposit copper, however, PVD copper deposition is known to encounter difficulty in obtaining adequate bottom fill in high aspect ratio features. Additionally, chemical vapor deposition (CVD) may be used to deposit copper, however, CVD suffers from low deposition rates, and therefore low throughput, in addition to using precursors that are difficult to manage. Additionally, copper is difficult to pattern with conventional semiconductor processing techniques, and therefore, copper must generally be deposited directly into features, where conventional aluminum techniques allowed for deposition and patterning of the conductive features. In view of these challenges, electroless and electroplating deposition techniques have become an attractive option for depositing metal, specifically copper and copper alloys, onto semiconductor substrates and into high aspect ratio features.

Conventional electroplating methods generally include positioning a substrate 101 on a substrate support member 102 in a face down configuration, i.e., the receiving surface 103 of the substrate support member secures the substrate 101 thereto such that the exposed surface of the substrate faces downward, as illustrated in FIG. 1. The substrate support member 102 is then lowered into a plating bath 104, which generally comprises an electrolytic solution. An electrical bias is then applied between the surface of the substrate and an anode positioned in the plating bath, which operates to urge metal ions in the plating solution, which may be copper ions, to deposit on the substrate surface. During non-processing time periods, i.e., when substrates are not being plated, the electrolytic solution is generally circulated through a continual path that includes a relatively small volume plating bath/cell 104 and a substantially larger volume storage cell 105. The storage cell 105, for example, may hold approximately 200 liters of plating solution, while the plating cell 104 may hold approximately 2 liters of plating solution. Additionally, the continual fluid path may include an electrolyte replenishment device 106 configured to replenish portions of the plating solution that may be depleted through plating operations.

Typical electrolyte solutions used for copper electroplating generally consist of copper sulfate solution, which provides the copper to be plated, having sulfuric acid and copper chloride added thereto. The sulfuric acid generally operates to modify the acidity/pH and conductivity of the solution, while the copper chloride provides negative chlorine ions needed for nucleation of suppressor molecules and facilitates proper anode corrosion. The electrolytic solutions also generally contain various organic molecules, which may be accelerators, suppressors, levelers, brighteners, etc. These organic molecules are generally added to the plating solution in order to facilitate void-free super-fill of features and planarized copper deposition. Accelerators, for example, may be sulfide-based molecules that locally accelerate electrical current at a given voltage where they absorb. Suppressors may be polymers of polyethylene glycol, mixtures of ethylene oxides and propylene oxides, or block copolymers of ethylene oxides and propylene oxides, for example, which tend to reduce electrical current at the sites where they absorb, and therefore, slow plating at those locations. Levelers, for example, may be nitrogen containing long chain polymers, which operate to facilitate planar plating.

During the plating process, copper ions are continually being removed and replenished to/from the electrolytic solution, and therefore, the copper concentration of the electrolyte inherently changes or varies over time. This concentration change may further be affected by volume depletion of the plating solution and/or dissolution of the anode. Additionally, plating operations also deplete the various organic molecules in the electrolyte solution, and therefore, the organic concentration also varies over time. For example, levelers are known to deplete/breakdown upon exposure to oxygen containing elements, i.e., ambient air, oxygen absorbed into the plating solution, oxygen molecules contained in the anode metal, or oxidation encountered during plating by incorporation into a growing film. This breakdown process generates free radicals in the plating solution, which are undesirable, as the free radicals can deposit on a substrate and contaminate the metal layer. Further, levelers are known to breakdown upon exposure to copper, copper alloys, and/or platinum, all of which are typical anode materials for electroplating systems. Similarly, accelerators and suppressors may also suffer from depletion/breakdown characteristics as a result of oxygen and/or metal exposure. Depletion of organics is not limited to processing time periods, as the electrolyte solution in electroplating systems is generally continually circulated through the plating cell, storage unit, and potentially a replenishment device during non-processing time periods. As a result of the circulation, the plating solution may be continually exposed to both oxygen-containing elements and the metal anode. Therefore, as a result of this exposure, the organic molecules in the plating solution are continually being depleted, even though the plating system is not in a plating or operational mode.

Inasmuch as the concentration of the organics in the plating solution and the concentration of the radicals generated by organic molecule breakdown process both have a substantial effect upon the efficiency and controllability of plating operations, replenishment of depleted organics in the plating solution, as well as maintaining specific organic concentrations is desired. Conventional plating systems generally provide a replenishment module configured to add fresh organics into the plating solution in order to replenish depleted organic molecules. However, conventional organic replenishment processes generally require time consuming organic molecule measurement processes, which decreases the accuracy of conventional organic replenishment processes, as the time duration required for measurements substantially decreases the accuracy of conventional organic replenishment processes and may cause an organic concentration variance. This variance in organic concentration may detrimentally affect the ability to accurately control conventional electroplating apparatuses.

Therefore, there exists a need for a method and/or apparatus for accurately replenishing organic molecules in an electroplating bath during plating operations. Additionally, there is a need for an apparatus and/or method for minimizing organic molecule depletion during non-processing time periods.

SUMMARY OF THE INVENTION

Embodiments of the present invention generally provide an apparatus and method for replenishing organic molecules in an electroplating bath. The replenishment process of the present invention may occur on a real-time basis, and therefore, the concentration of organics minimally varies from desired concentration levels. The replenishment method generally includes conducting pre-processing depletion measurements in order to determine organic depletion rates per current density applied in the electroplating system. Once the organic depletion rates per current density are determined, these depletion rates may be applied to an electroplating processing recipe to calculate the volume of organic depletion per recipe step. The calculated volume of organic depletion per recipe step may then be used to determine the volume of organic molecule replenishment per unit of time that is required per recipe step in order to maintain a desired concentration of organics in the plating solution. The calculated replenishment volume may then be added to the processing recipe so that the replenishment process may occur at realtime during processing periods.

Embodiments of the invention generally provide an electrochemical plating apparatus configured to plate copper onto semiconductor substrates, while minimizing the depletion of organics during non-processing time periods. The apparatus generally includes a plating cell configured to contain a plating bath, a substrate support member positioned above the plating bath and being configured to selectively contact the plating bath with a substrate secured thereto, and an electrolyte fluid supply line in fluid communication with the plating bath. Additionally, the plating apparatus may include a selectively actuated check valve positioned in the electrolyte fluid supply line, and an electrolyte bleed line in fluid communication with the plating bath.

Embodiments of the invention further provide a method for reducing organic depletion in an electrochemical plating system during non-processing time periods. The method generally includes the steps of closing an electrolyte feedline in order to isolate a plating cell from electrolyte supplied during a non-processing time period, and draining at least a portion of the remaining electrolyte solution from the plating cell by opening a bleed valve in fluid communication with the plating cell.

Embodiments of the invention further provide a method for reducing electrolyte depletion, wherein the method includes closing a check valve in an electrolyte supply line in order to terminate electrolyte flow to a processing cell during a non processing time period. The method further includes opening a bleed line valve in fluid communication with the processing cell bleed line in order to drain electrolyte from the processing cell during the non processing time period, opening the check valve during a processing cell started time period, and closing a bleed valve during a processing time period.

BRIEF DESCRIPTION OF THE DRAWINGS

So that the manner in which the above recited features of the present invention are attained and can be understood in detail, a more particular description of the invention briefly summarized above may be had through reference to the exemplary embodiments thereof, which are illustrated in the appended drawings. It is to be noted, however, that the appended drawings illustrate only typical or exemplary embodiments of this invention and are therefore not to be considered limiting of its scope, for the invention may admit to other equally effective embodiments.

FIG. 7 illustrates an exemplary depletion determination and processing recipe modification method of the invention.

DETAILED DESCRIPTION OF THE PREFERRED EMBODIMENT

Figure 1:
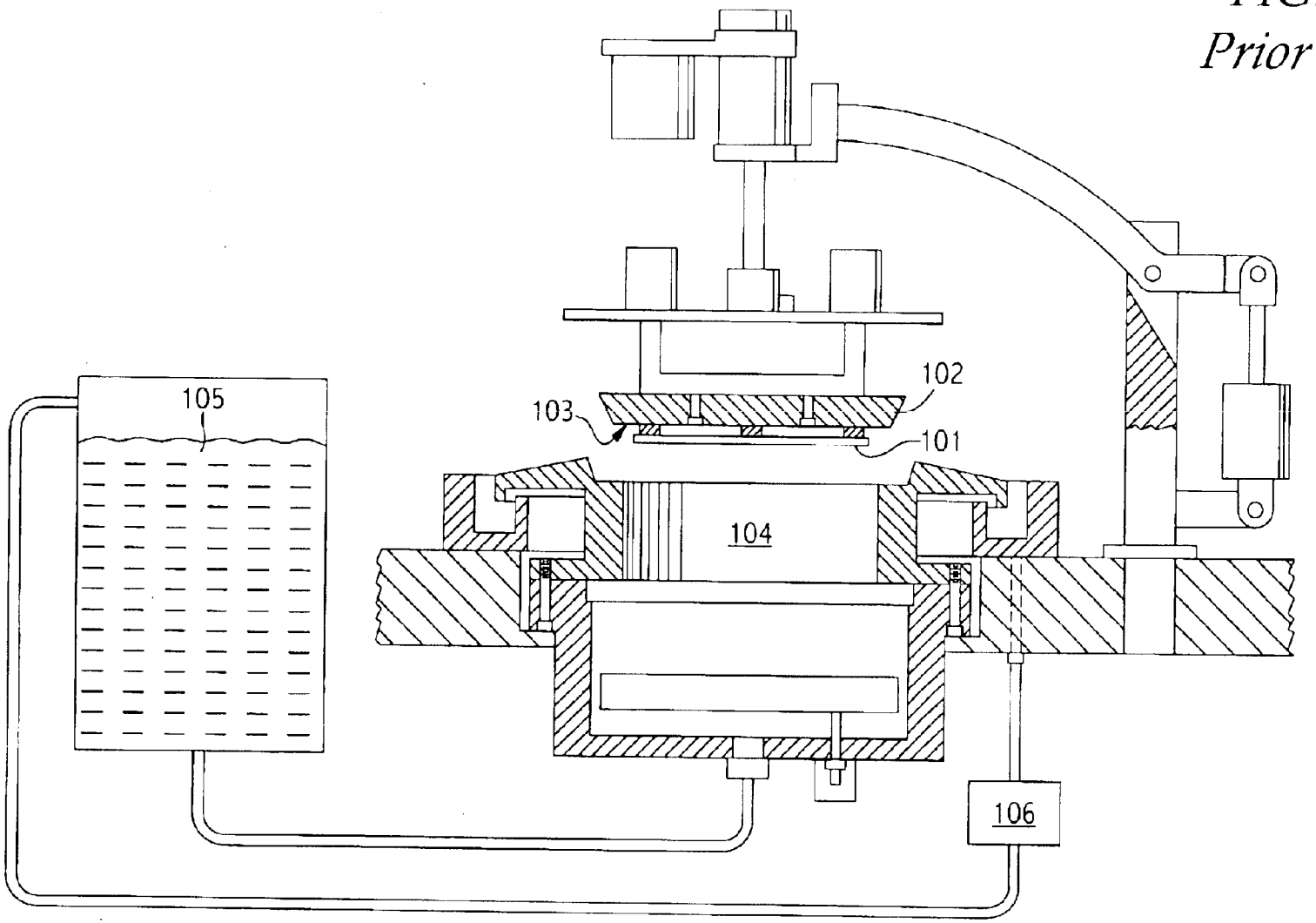
FIG. 1 Prior Art
FIG. 1 illustrates a conventional plating apparatus.
Figure 2:
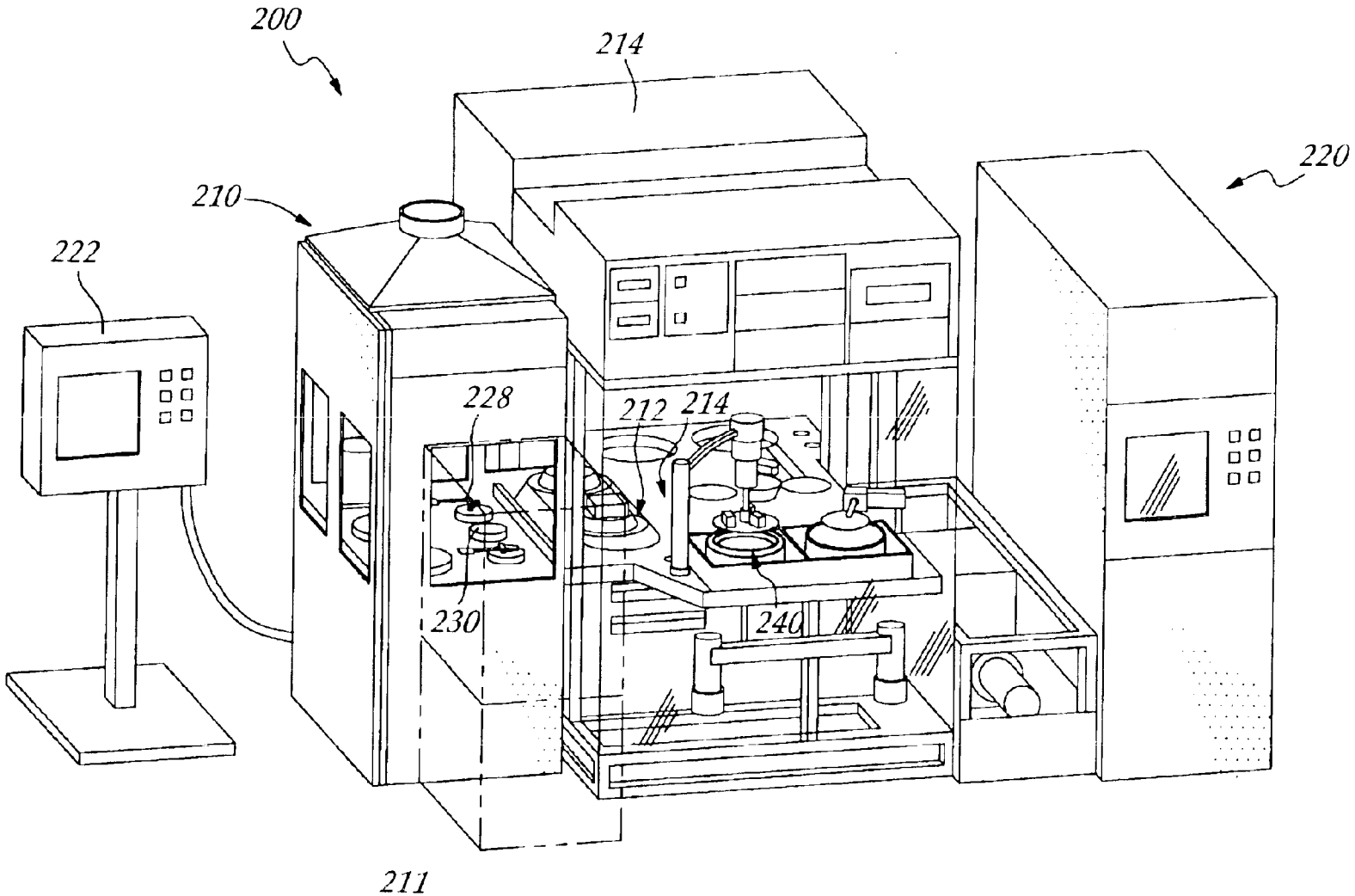
FIG. 2 illustrates a perspective view of an exemplary plating apparatus of the invention.
Figure 3:
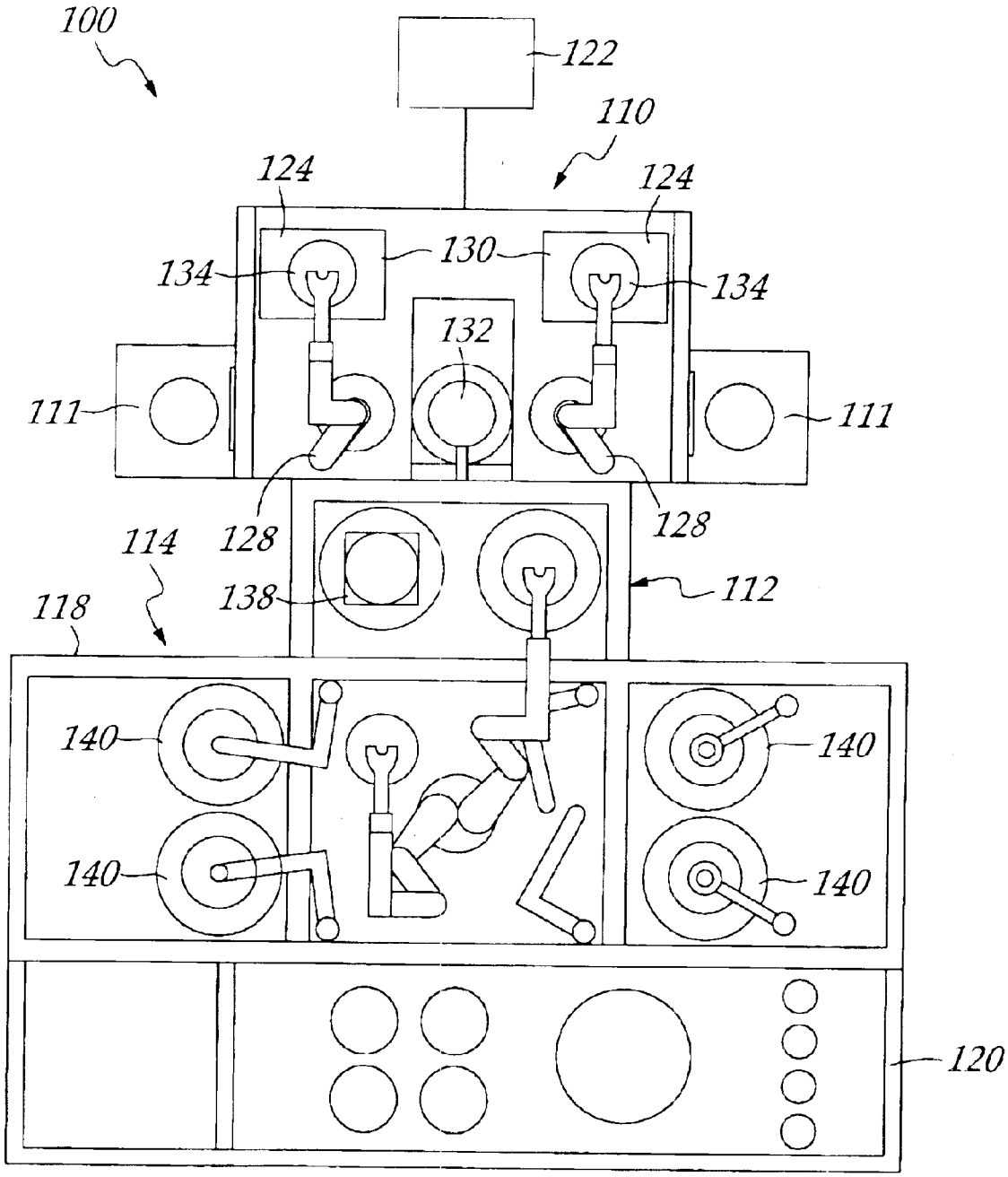
FIG. 3 illustrates a plan view of an exemplary plating apparatus of the invention.

FIG. 2 is a perspective view of an exemplary electroplating system platform 200 of the invention. FIG. 3 is a schematic plan view of the exemplary electroplating system platform 200 of the invention. Referring cooperatively to FIGS. 2 and 3, the electroplating system platform 200 generally includes a loading station 210, a thermal anneal chamber 211, a spin-rinse-dry (SRD) station 212, a mainframe 214, and an electrolyte replenishing system 220. The mainframe 214 generally includes a plurality of processing stations 218. Each processing station 218 may include one or more processing cells 240. An electrolyte replenishing system 220 is generally positioned adjacent the electroplating system platform 200 and individually in fluid communication with each of process cells 240 in order to circulate fresh electrolyte thereto that will be used for the electroplating process. The electroplating system platform 200 may also include a control system 222, which may be a programmable microprocessor-type controller configured to interface with the various components of system platform 200 and provide controlling signals thereto. Control system 222, for example may be used to control parameters associated with the plating process, such as electrical bias applied to a substrate, duration of substrate exposure to electrolyte solutions, rotation rates of substrate support members, flow rates of electrolyte into plating cells, flow rates of organic molecules into the plating solution via the replenishment module 220, actuation of valves related to the plating process, i.e., check valves and bleed valves, along with other parameters generally associated with the execution of the semiconductor processing recipe in a plating apparatus. Loading station 210 generally includes one or more substrate cassette receiving areas 224, one or more loading station transfer robots 228, and at least one substrate orientor 230. The number of substrate cassette receiving areas 224, loading station transfer robots 228, and substrate orientors 230 included in the loading station 210 may be configured according to the desired throughput requirements of the particular system.

Figure 4:
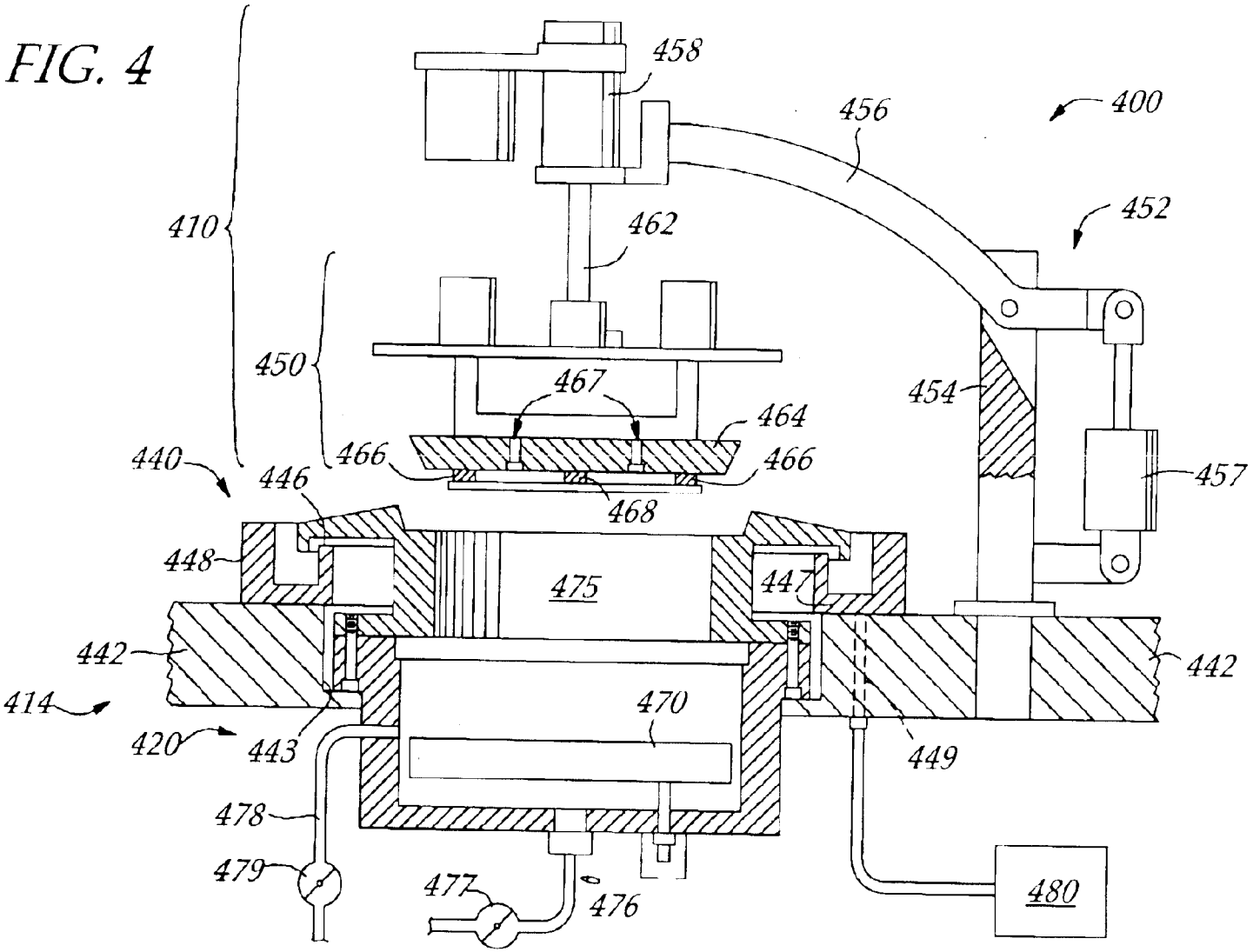
FIG. 4 illustrates a sectional view of an exemplary plating cell of the invention.

FIG. 4 is a cross sectional view of an exemplary electroplating process cell 400 of the invention. The electroplating process cell 400, for example, may be implemented into the process cell location 240 illustrated in FIG. 3. Process cell 400 generally includes a head assembly 410, a process kit 420, and an electrolyte collector 440. Preferably, the electrolyte collector 440 is secured onto the body 442 of the mainframe 414 over an opening 443 that defines the location for placement of the process kit 420. The electrolyte collector 440 includes an inner wall 446, an outer wall 448, and a bottom 447 connecting the respective walls. An electrolyte outlet/overflow 449 may be disposed through the bottom 447 of the electrolyte collector 440 and connected to an electrolyte replenishing system 480 through tubes, hoses, pipes, or other fluid transfer connectors. The outer wall 421 of process kit 420 defines an open top enclosure 475 configured to contain an electrolytic plating solution therein. Enclosure 475 includes an electrolyte supply line 476 that is generally in communication with an electrolyte supply or storage unit and includes a check valve 477, which may generally operate to selectively terminate electrolyte flow-through supply line 476. Supply line 476 is generally configured to supply electrolyte from a storage container to the processing enclosure 475. Enclosure 475 may further include an electrolyte bleed line 478, which may be in fluid communication with enclosure 475 and positioned vertically within the outer wall 421 of enclosure 475 at a level just above an upper surface of an anode 470 positioned within enclosure 475. Bleed line 478 may include a selectively actuated valve 479, which may be used to initiate bleed line flow of electrolyte out of enclosure 475. Bleed line 478 may be in fluid communication with a fluid drain, or alternatively, bleed line 478 may be in communication with the storage/replenishment device mentioned above.

Figure 5:
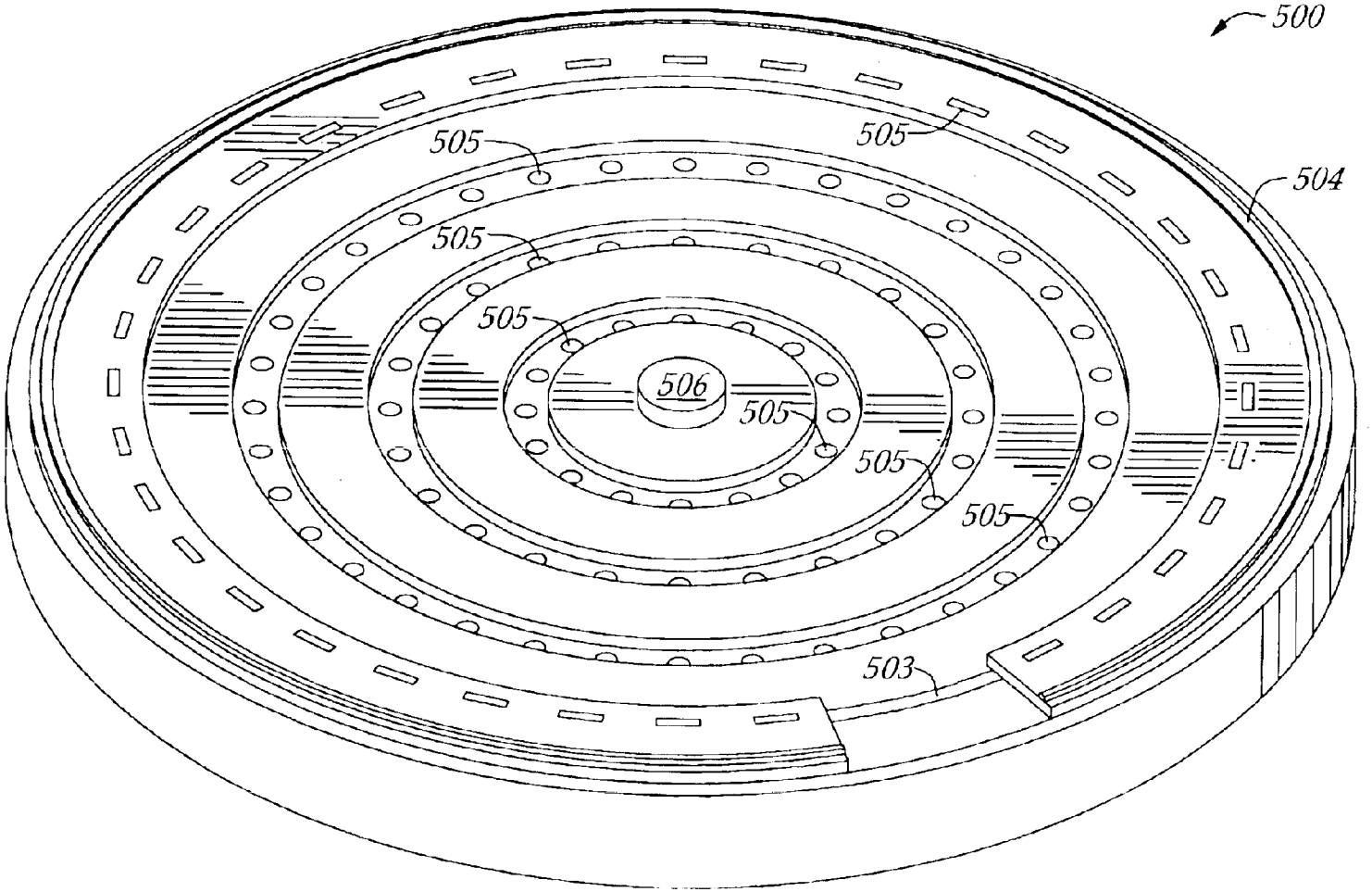
FIG. 5 illustrates a perspective view of an exemplary substrate support member of the exemplary plating apparatus illustrated in FIG. 4.
Figure 6:
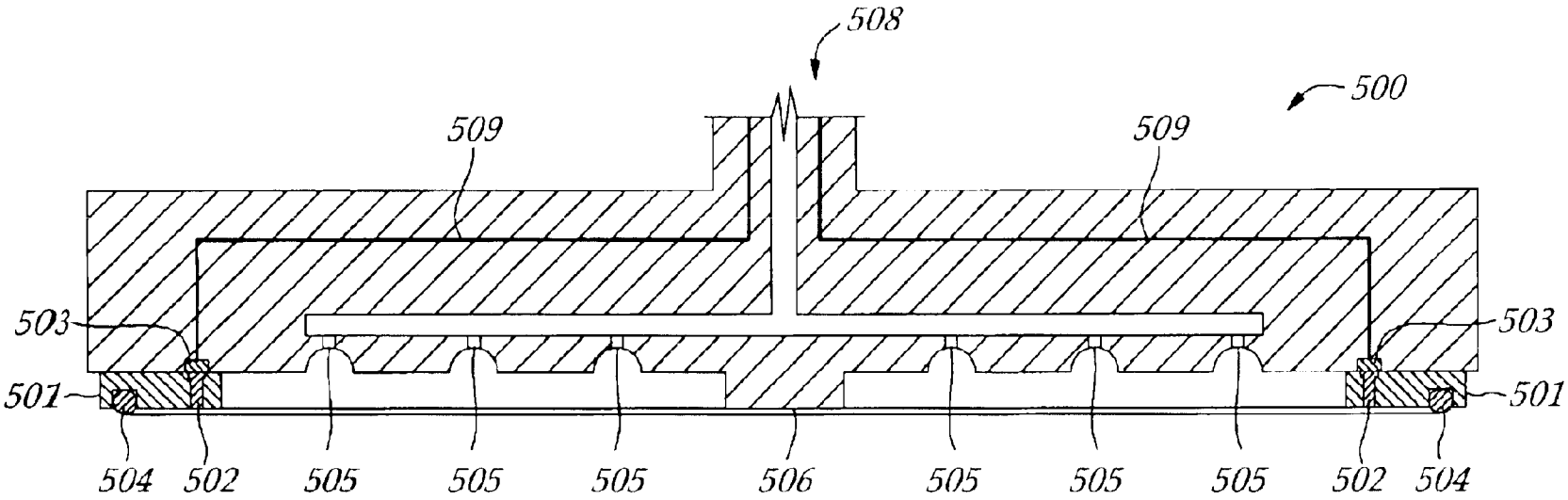
FIG. 6 illustrates a sectional view of the exemplary substrate support assembly illustrated in FIG. 5.
Figure 2:
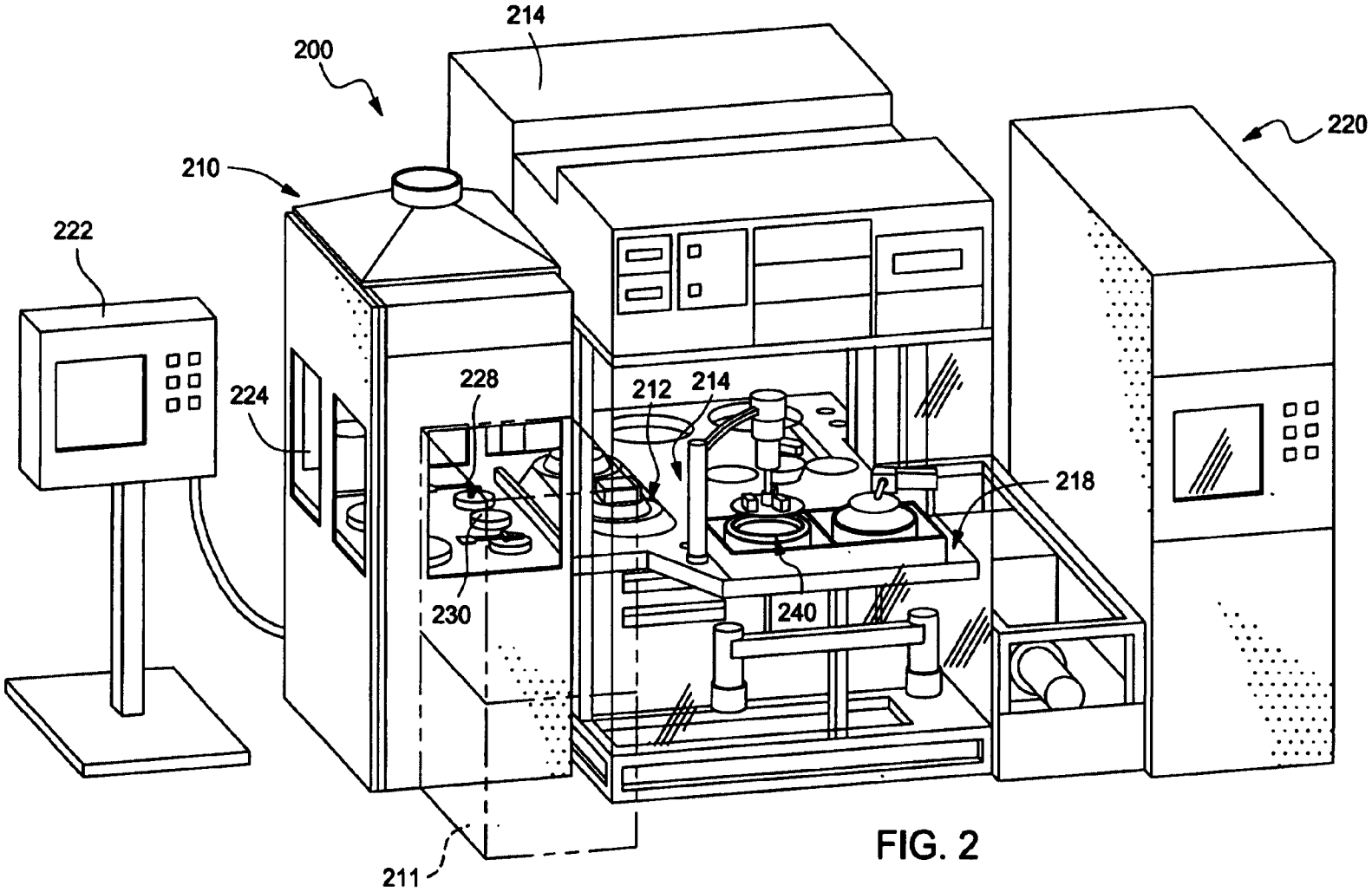
Figure 3:
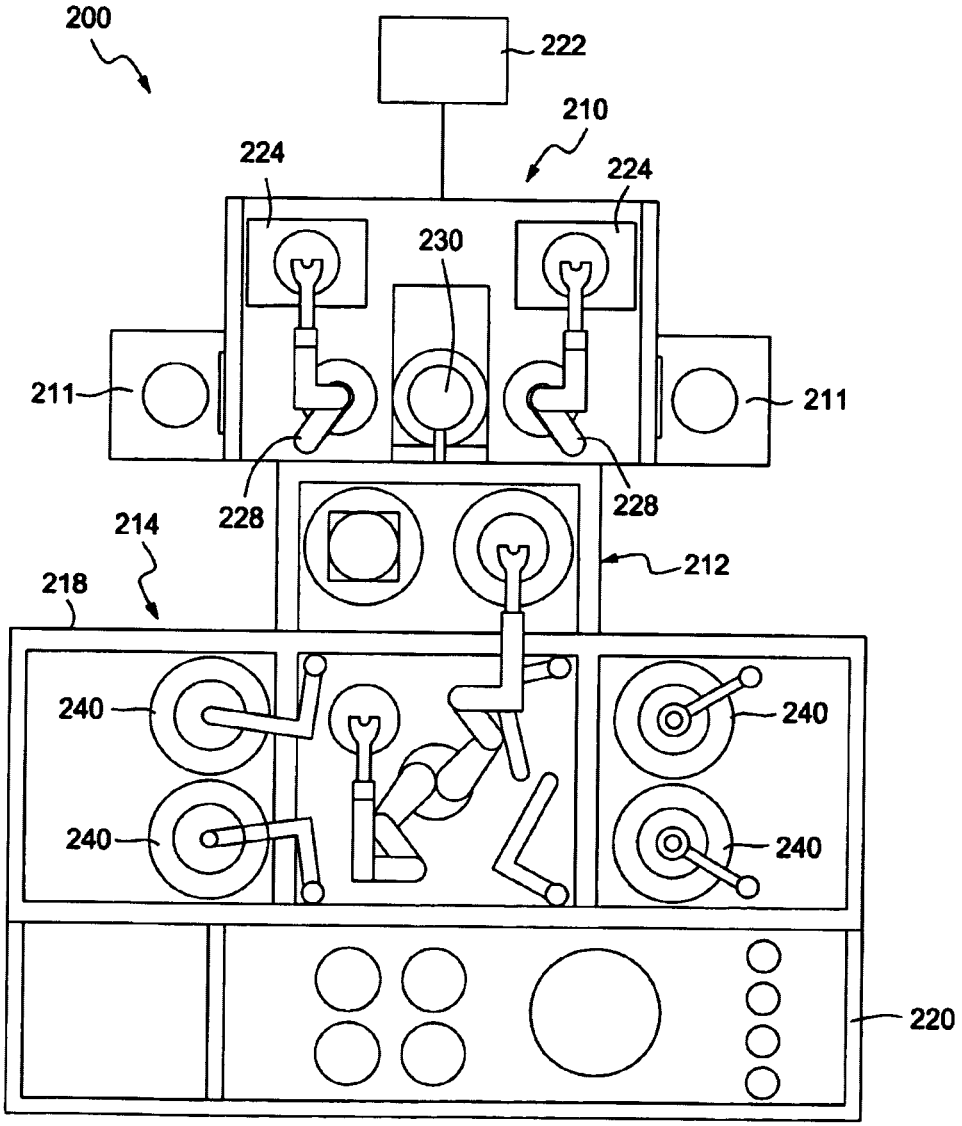
Figure 4:
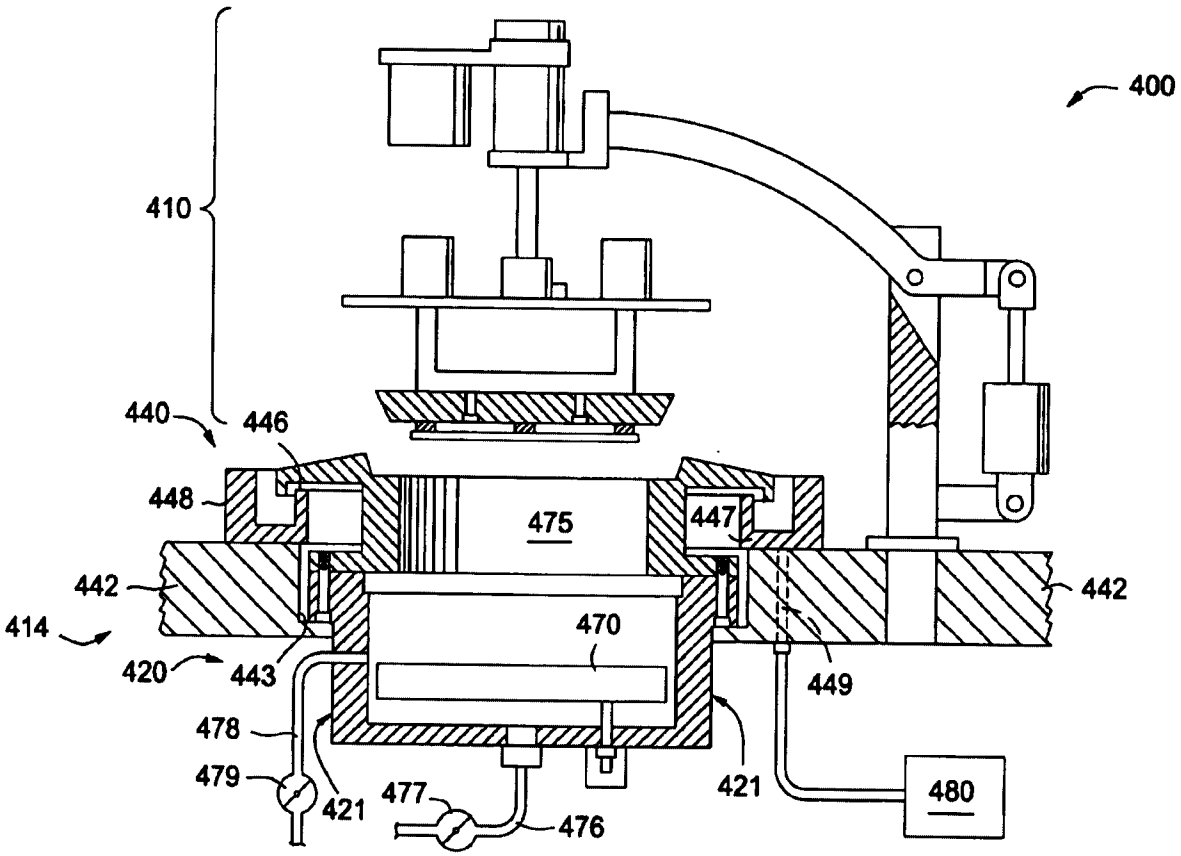
Figure 5:
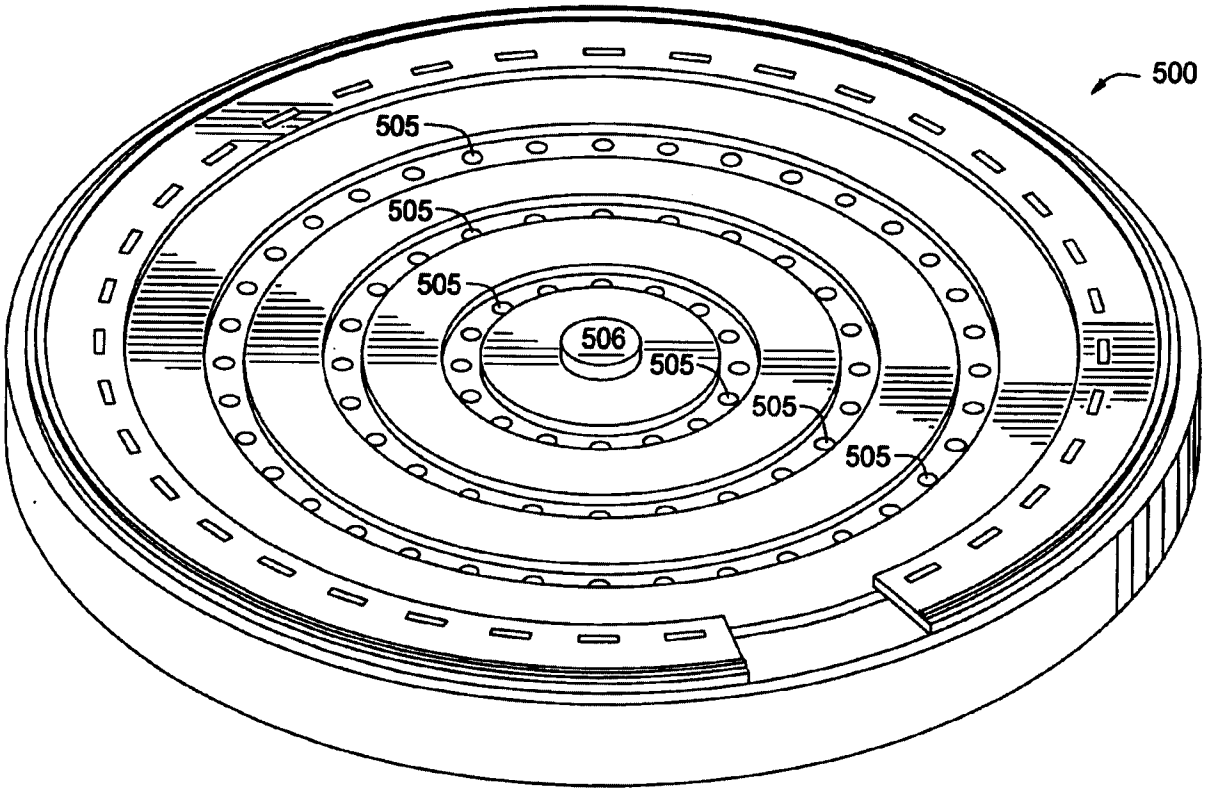
Figure 6:
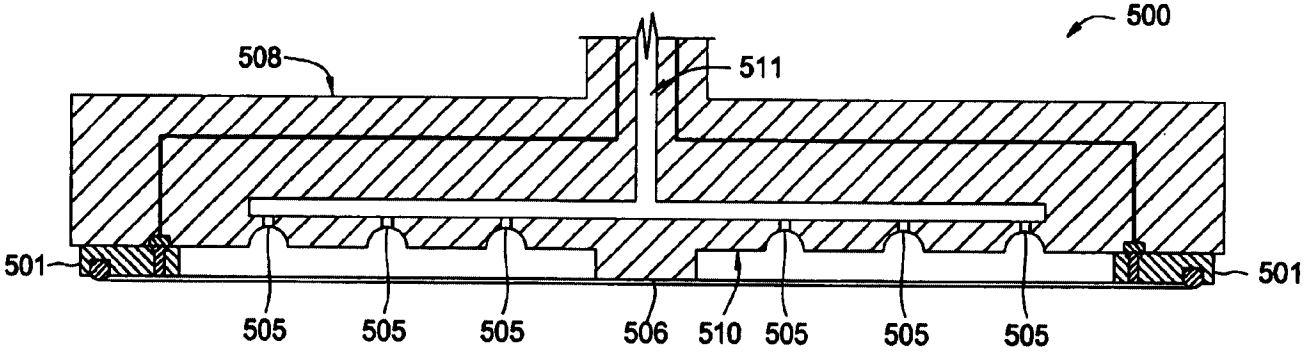

FIG. 5 illustrates a perspective view of an exemplary substrate support assembly 500 of the invention. FIG. 6 illustrates a sectional view of the exemplary substrate support assembly 500 illustrated in FIG. 5. Substrate support assembly 500 generally includes a circular or disk shaped member having an upper surface 508 and a lower surface 510, where the lower surface 510 is configured to receive, secure, and electrically contact a substrate. A substrate may generally be secured to substrate support assembly 500 through a vacuum chucking process, whereby a vacuum source (not shown) may be in communication with a plurality of vacuum channels, ports, or other apertures 505 formed into the lower surface 510 of the substrate support assembly 500 in a configuration calculated to secure/chuck a substrate to the lower surface 510 upon application of a sufficient negative pressure/vacuum to the plurality of channels 505. The vacuum source (not shown) may be in communication with the apertures 505 via a vacuum conduit 511 formed in substrate support assembly 500. Therefore, when a negative pressure is applied to the apertures 505 by the vacuum source, the pressure operates to bias or chuck a substrate against an annular cathode contact ring 501 positioned about the perimeter of the lower surface 510 of substrate support assembly 500. A center substrate support member 506 may be positioned proximate the center of lower surface 510. Center support member 506 generally operates as a central support member or spacer between the lower surface 510 of the substrate support member 500 and the substrate chucked to support assembly 500, as the vacuum chucking process may cause the central portion of a substrate to bow towards support assembly 500. Therefore, center support member 506 may be configured to support the central portion of a substrate and prevent excessive substrate deflection or bowing as a result of the vacuum chucking process.

In operation, embodiments of the invention and may be used to adjust the concentration of organics in an electrolyte plating solution in a real-time manner, i.e., the organic concentration may be supplemented/adjusted by a replenishment module at the same time as the organic concentration is being depleted by a plating process. The supplement/adjustment process may generally be calculated to replace the quantity of organic molecules depleted by the plating process in a specific unit of time with an equal quantity of fresh organic molecules in the same unit of time. The organic replenishment may be inserted into the plating cell/plating bath itself, into the plating cell outlet line, or at another preferred point in the plating system. The process of accomplishing real-time organic molecule concentration adjustment for an electrolytic solution generally begins with a depletion rate determination process.

A depletion rate determination process generally includes executing at least one test run of the plating system to determine the depletion rate of specific organic molecules from the plating solution as a function of the current density applied in the plating process. For example, in a plating system where the current density applied during plating operations is generally between 10 $A/cm^2$ and 15 $A/cm^2$, the test run process may include an incremental test of current densities between 10 and 15 $A/cm^2$. This type of test run process, for example, may include plating a substrate at 10 $A/cm^2$ for a predetermined period of time, and then measuring the depletion of organic molecules from the electrolyte solution at the end of the predetermined period of time. Once the depletion of organics for the tested current density is measured/known for the given current density over the predetermined unit of time, the depletion of the organics per individual unit of time for the given current density may be determined through calculation, assuming that the initial or starting organic concentration is known before the test run process is commenced. The calculation process, for example, may determine an organic concentration differential, i.e., the difference between the organic concentration before the test run and the organic concentration after the test run, and then use the concentration differential to determine the volumetric depletion of organics during the test run process. Once the volumetric depletion is determined, it may be divided by the test run duration to determine the volumetric depletion per unit time. Therefore, for example, if a test run measurement of plating at 10 A/cm$^2$ for 20 units of time determines that 40 volumetric units of a specific organic molecule (organic "A") are depleted during the 20 units of time, then it may be determined/calculated that the depletion of organic A per unit of time for a current density of 10 A/cm$^2$ is 2 volumetric units per unit of time. This test, measure, and calculate process may then be incrementally repeated for various current densities within the range of normal operation of the particular plating system. For the exemplary system noted above that generally operates in the 10 A/cm$^2$ to 15 A/cm$^2$ range, test runs may be executed at 11 A/cm$^2$, 12 A/cm$^2$, 13 A/cm$^2$, 14 A/cm$^2$, and 15 A/cm$^2$, for example, wherein each test run may be conducted for a predetermined time interval.

Once the depletion rates for organic molecules are determined for the current densities used in a particular plating operation or system, the plating processing recipe may be modified to include control of an organic molecule replenishment unit. More particularly, the plating processing recipe may be modified to include the time varying addition of a calculated volume of organic molecules to the plating solution by a replenishment unit. As such, while organics are being depleted from the plating solution by plating operations, a replenishment unit may simultaneously operate to replenish the depleted volume of organic molecules in the electrolyte solution, which operates to maintain a constant concentration of organic molecules in the electrolyte solution over a processing time. Additionally, the test run process may be utilized to determine the volumetric depletion of a plurality of organics from the electrolyte solution, and therefore, allow for real time replenishment of a plurality of organics in the electrolyte solution, wherein real time replenishment is generally understood to mean replenishment of the depleted organics at generally the same time as the depletion is occurring. Therefore, in the embodiments of the invention, for example, the depleted organics may be replenished into the electrolyte solution during the processing step within which they are depleted.

FIG. 7 illustrates an exemplary depletion determination and processing recipe modification method of the invention. The method generally includes the steps of conducting a number of test runs, calculating the volume of organic depletion per unit time for each current density used in the test runs, and modifying the plating processing recipe to include a time varying replenishment of the depleted organics. The test run process, which is illustrated as step 1, generally includes operating the plating system under normal operational conditions over a range of current densities. For example, for a plating system that normally operates at current densities in the 10 to 15 A/cm$^2$, test runs may be run for the system at current densities of 10, 11, 12, 13, 14, and 15 A/cm$^2$ for predetermined durations for each particular current density. After each individual test run for each individual current density is completed, the depletion of the organics from the plating solution for the particular test run may be measured.

Using a current density of 10 A/cm$^2$ as an example, the plating system may be run with the current density of 10 A/cm$^2$ for 20 units of time. Once the 10 A/cm$^2$ test run is complete, the plating solution in the plating system may be measured to determine the remaining concentration of organics in the plating solution. Using the measured organic concentration, the volumetric depletion of the organics may be determined. For example, in the 10 A/cm$^2$ test run, it may be determined that 40 volume units of organics were depleted from the solution during the 20 units of time of the test run. Therefore, using this information, the method of the invention may then calculate the volumetric depletion of organics per unit time for a current density of 10 A/cm$^2$, which is illustrated as 2 volumetric units of organics depleted per unit of time (40 volumetric units depleted divided by 20 units of time yields 2 volumetric units depleted per individual unit of time). This process may then be repeated for various other current densities. In the exemplary method illustrated in FIG. 7, the current density test runs are repeated for current densities of 11, 12, 13, 14, and 15 A/cm$^2$, each using a time duration of 20 units of time. However, although 20 units of time are illustrated for each current density test run in the exemplary method illustrated in FIG. 7, it is not necessary or required for the test run time duration to be identical for each test run. Rather, the time duration may be varied per current density test run in order to increase the efficiency of the individual run, i.e., if depletion for a particular current density may be accurately measured in a shorter time duration, then the duration may be shortened. Similarly, if a particular current density requires a longer test run duration in order to obtain an accurate depletion measurement, the time duration may be lengthened to accommodate an accurate measurement.

Additionally, although current densities of 10 to 15 A/cm$^2$ are illustrated in the exemplary method of FIG. 7, the invention is in no way limited to these current densities. Rather, it is contemplated that the method of the present invention may be applied to a wide range of current densities. It is to be noted, however, that generally the range of current densities implemented in the test runs will be determined by the normal operational current density range of a plating process or apparatus. For example, if a particular plating operation or apparatus generally operates using current densities in the range of 35 to 55 A/cm$^2$, then the test runs may be adjusted to incorporate this current density range. Similarly, if the normal operation range for a plating system uses current densities between 2 A/cm$^2$ and 2.2 A/cm$^2$, then the test runs may be conducted at 2, 2.05, 2.10, 2.15, and 2.2 A/cm$^2$, for example. Therefore, generally speaking, the range of current densities utilized in the test runs may be determined by the normal operational current density range used in the plating process of a particular processing recipe or plating apparatus, regardless of the magnitude of the current density.

Once the test run process is complete, the method of the invention generally includes calculating the volumetric depletion of organics per unit of time for each current density implemented in the test runs, as illustrated in step 2 of FIG. 7. This calculation, which is briefly discussed above, generally includes determining the volumetric depletion of the concentration of organics in the plating solution during the individual test runs. Once the volumetric depletion of organics is determined, the volumetric depletion may be divided by the time duration of the test run at the particular current density in order to yield the volumetric depletion of organic material per unit of time for the respective current density. As illustrated in FIG. 7, for example, for the 14 A/cm$^2$ current density test run, it may be determined from the concentration change of organics in the plating solution that the volumetric depletion of organics from the plating solution is 50 volume units. The volumetric depletion may then be divided by the duration of the test run to determine the volumetric organic depletion per unit time. For example, for the 14 A/cm$^2$ test run it was determined that 50 volume units of organics were depleted from the plating solution over 20 units of time. Therefore, dividing 50 volume units by 20 units of time yields an organic volumetric depletion per unit time of 2.5. The calculation of the volumetric depletion per unit time may be repeated for each individual current density used in the test run process. As such, the volumetric depletion per unit time may be calculated for each current density that may be used in the operation of the plating system.

Once the volumetric depletion per unit time is determined for the respective current densities used in the plating system, i.e., for each test run, then a processing recipe implemented in the plating system may then be modified and/or adjusted to include real-time replenishment of the depleted organics during the plating process. For example, as illustrated in step 3 of FIG. 7, an exemplary processing recipe having four individual recipe steps therein (A, B, C, and D) may be modified to include real-time replenishment of depleted organics within the individual recipe steps. Within recipe step A, for example, it may be determined from the test run that using a current density of 10 A/cm$^2$ requires organic replenishment of 2 volumetric units of organics per unit time. Therefore, during the five units of time of recipe step A, organics may be replenished into the plating solution at a rate of 2 volumetric units of organics per unit of time, as step A operates at 10 A/cm$^2$, and this current density has been found to deplete 2 volumetric units of organics per unit of time in the test run process Therefore, although the plating operation is depleting organics at a rate of 2 volumetric units per unit time, the present invention is simultaneously replenishing 2 volumetric units of organics into the plating solution during the plating process. Therefore, the resulting organic depletion rate in the plating solution is nullified, as the organics being depleted from the solution are simultaneously being replaced by a replenishment process. Further, the organic concentration gradient may be minimized, as the concentration of organics generally will not vary using the present invention. The replenishment process may continue through the remaining recipe steps (B, C, and D) in a similar manner to that described for step A. For example, during the 10 units of time of recipe step B, 25 volumetric units of organics may be replenished into the plating solution, as it was calculated from the test run that 2.5 volumetric units of organics are depleted per unit time from the plating solution while the plating process is operating at a current density of 14 A/cm$^2$. Similarly, during recipe steps C and D, 11.5 and 10 volumetric units may be replenished into the plating solution, respectively.

During the method of the present invention, a microprocessor-type controller may be configured to control the test run process, the calculation process, the recipe modification process, and the implementation of the processing recipe to control electrochemical plating process. For example, a microprocessor-type controller may be in electrical communication with the various elements of an electrochemical plating system, such that the controller may operate the plating system over a range of current densities for predetermined durations to complete the test run process. Further, the controller may be configured to receive measurement inputs from the test run process, and calculate the volumetric depletion of organics per unit time for each of the current densities implemented in the test run process. Further still, the controller may be configured to modify/add one or more elements to a semiconductor processing recipe, wherein the additional elements may correspond to a volumetric replenishment of depleted organics per unit time. More particularly, the controller may be configured to modify an electrochemical plating recipe, such that the electrochemical plating recipe includes control over a replenishment unit configured to replenish depleted organics from the electrochemical plating bath in a real-time manner. Finally, the controller may also be configured to execute the processing recipe, i.e., to control the plating process.

Additionally, the microprocessor-type controller may also be used to extrapolate data between test run current densities. For example, if test runs having current densities of 15 A/cm$^2$ and 17 A/cm$^2$ are run, and a processing recipe step utilizes a current density of 16 A/cm$^2$, then the microprocessor type controller may be used to extrapolate the appropriate volumetric replenishment of organics for the current density of 16 A/cm$^2$. The extrapolation process may, for example, use a weighted average's method to determine volumetric depletion rates for current densities not specifically tested in the test run process.

In another embodiment of the invention, depletion of organics during non-processing time periods may be minimized. For example, a method for reducing depletion of organics during non-processing time periods may include the steps of isolating the processing cell and draining the process cell. The isolation step generally includes closing a check valve positioned in the electrolyte supply line, i.e., in the line supplying fresh electrolyte to the processing cell for processing. For example, referring to the exemplary plating apparatus 400 illustrated in FIG. 4, check valve 477 may be closed in order to terminate the flow of fresh electrolyte into processing region 475 during non-processing time periods. Therefore, with check valve 477 closed, processing region 475 is generally isolated. Once processing region 475 is isolated, a substantial portion of the remaining electrolyte solution contained within processing region 475 may be drained therefrom. For example, again referring to the plating apparatus 400 illustrated in FIG. 4, a substantial portion of the electrolyte solution contained in processing region 475 may be removed therefrom by bleed line 478. The removal process generally includes opening a bleed valve 479 such that the electrolyte solution contained within processing region 475 may be allowed to flow out bleed line 478. Bleed line 478 may be in communication with a fluid drain, an electrolyte replenishment device, or an electrolyte storage cell, for example. Assuming bleed line 478 is positioned in the sidewall 421 of processing region 475 just above anode 470, within bleed line 478 may operate to remove a substantial portion of the electrolyte solution from processing region 475, while leaving enough electrolyte solution to maintain the anode 470 in solution. Therefore, assuming the volume of processing region 475 is approximately two liters, bleed line 478 may be used to remove approximately 1 to ½ liters of electrolyte solution therefrom. When a substantial portion of the electrolyte solution contained within processing region 475 has been removed, then bleed valve 479 may be closed to again isolated processing region 475. Alternatively, if anode 470 does not need to be maintained in solution, then bleed line 478 may be positioned in the bottom of the electrolyte container so that substantially all of the electrolyte may be drained from the electrolyte container during non-processing time periods.

With a substantial portion of the electrolyte solution removed from processing region 475, and with processing region 475 isolated from the remaining volume of electrolyte solution in the plating system, the depletion of organics during the non-processing time period is minimized. The minimized depletion of the organics is a result of the electrolyte solution neither flowing over the anode 470 nor contacting oxygen containing elements. Rather, the bulk of the electrolyte solution is maintained in an electrolyte storage container positioned proximate the plating apparatus 400 and is not continually circulated through the plating cell 475. Inasmuch as electrolyte circulation during non-processing time periods results in a substantial portion of the electrolyte depletion during non-processing time periods, electrolyte depletion is minimized by the isolation and draining method of the present invention.

Once the non-processing time period is over, plating apparatus 400 may be returned to a processing mode. The transformation from the non processing time period to a processing mode may generally include a starter or initialization phase. For example, the starter or initialization phase may be configured to refill the processing region 475 with fresh electrolyte prior to commencing plating operations. As such, the initialization phase may include opening of check valve 477, such that fresh electrolyte may begin to flow into and fill up processing region 475. The filling process may include leaving bleed line 479 open, such that fresh electrolyte may be allowed to flush processing region 475, i.e., fresh electrolyte may be pumped into processing region 475 by fluid supply line 476, while electrolyte is simultaneously being removed from processing region 475 by bleed line 478. As such, processing region 475 is flushed of the portion of electrolyte that remained therein during the non-processing time period, i.e., the old electrolyte that was used to maintain the anode immersed in fluid during the non processing time period may be removed. Once processing region 475 is flush to the old electrolyte, bleed valve 479 may be closed, and therefore, processing region 475 may be supplied with fresh electrolyte from supply line 476 for normal plating operations. Alternatively, another bleed line may also be positioned in a lower portion of processing region 475, and therefore, this additional bleed line may be used to simply dump the old electrolyte from processing region 475 during the initialization process in this embodiment, once the old electrolyte is dumped from processing region 475, check valve 477 may be opened and fresh electrolyte supplied to processing region 475 via fluid supply line 476.

In another embodiment of the invention, replenishment of organics may be undertaken via a real-time measurement process. For example, a plating system controller may be in electrical communication with a measurement device, i.e., a cyclic voltammetric stripping device (CVS). The measurement device may be configured to take a real-time measurements of the electrolyte plating solution, and more particularly, to take real-time measurements of the concentration of specific organics within the electrolyte plating solution. These real-time measurements taken by the measurement device may then be transmitted to the system controller. The system controller may process the measurements taken by the measurement device, which generally represent specific organic concentrations in the plating solution, and compare the measurements to a target organic concentration stored in a memory of the system controller. Using the comparison, the system controller may determine an appropriate volumetric replenishment of the specific organic measured by the measurement device. This determination made then be used by the system controller to control a chemical cabinet in fluid communication with the electrolyte plating solution, such that the chemical cabinet may dispense an appropriate time varying volume of the organic, such that the concentration of the organic in the electrolyte plating solution is maintained at or near the target organic concentration. Therefore, in general, the system controller may be implemented in a closed loop type configuration, where the system controller receives a measurement from a measurement device, processes the measurement to determine an appropriate replenishment volume, and then generates a control signal to be transmitted to a chemical cabinet, wherein the control signal is configured to control the chemical cabinet to replenish a measured element. This configuration generally operates in a real-time manner, in that the measurements are taken real-time, i.e., during processing or within a processing recipe step, and further, that the replenishment is conducted real-time, i.e., within a processing recipe step or during processing. However, it is to be noted that the closed loop type embodiment of the present invention is not limited to any particular system controller and/or measurement device, as it is contemplated within the scope of the present invention to use various system controllers and/or measurement devices known in the semiconductor art.

While the foregoing is directed to embodiments of the present invention, other and further embodiments of the invention may be devised without departing from the basic scope thereof, and the scope thereof is determined by the claims that follow.

What is claimed is:

1. An electrochemical plating apparatus, comprising:

a plating cell configured to contain a plating bath below an overflow outlet;

a substrate support member positioned in the plating cell and configured to selectively contact the plating bath with a substrate secured thereto;

a fluid supply line in fluid communication with the plating cell;

a selectively actuated check valve positioned in the fluid supply line;

an anode in the plating cell; and a bleed line in fluid communication with the plating cell at a position in the plating cell between the overflow outlet and the anode.

2. The electrochemical plating apparatus of claim 1, wherein the bleed line is positioned in a side wall of the plating cell and is configured to drain a portion of the plating bath.

3. The electrochemical plating apparatus of claim 2, wherein the bleed line is positioned in the side wall proximate a top portion of an anode positioned in the plating cell.

4. The electrochemical plating apparatus of claim 3, wherein the bleed line is configured to drain the plating cell, while leaving a sufficient amount of electrolyte in the plating cell to immerse the anode.

5. The electrochemical plating apparatus of claim 1, wherein the bleed line further comprises a selectively actuated bleed valve.

6. The electrochemical plating apparatus of claim 1, further comprising a microprocessor-type controller configured to regulate operational characteristics of the electrochemical plating apparatus.

7. The electrochemical plating apparatus of claim 6, wherein the microprocessor-type controller is configured to close the selectively actuated check valve in the fluid supply line and open the bleed line to drain a portion of the plating cell.

8. The electrochemical plating apparatus of claim 7, wherein the controller is configured to drain a portion of the plating cell during non-processing time periods by opening a selectively actuated bleed valve positioned in the bleed line.

9. An electrochemical plating apparatus, comprising:

a plating cell configured to contain a plating bath below an overflow outlet;

a substrate support member positioned in the plating cell and configured to contact a substrate with the plating bath;

a fluid supply line in fluid communication with the plating cell;

an anode in the plating cell; and a bleed line in fluid communication with the plating cell at a position in the plating cell between the overflow outlet and the anode.

10. The electrochemical plating apparatus of claim 9, wherein the bleed line is configured to drain a portion of the plating bath from the plating cell, while leaving a sufficient amount of plating bath in the plating cell to immerse the anode.

11. The electrochemical plating apparatus of claim 9, further comprising a check valve in the fluid supply line.

12. The electrochemical plating apparatus of claim 11, wherein the check valve is selectively actuated.

13. The electrochemical plating apparatus of claim 9, further comprising a valve in the bleed line.

14. The electrochemical plating apparatus of claim 13, wherein the valve in the bleed line is selectively actuated.

15. The electrochemical plating apparatus of claim 9, further comprising a microprocessor-type controller configured to regulate operational characteristics of the electrochemical plating apparatus.

16. The electrochemical plating apparatus of claim 15, further comprising a valve in the fluid supply line, wherein the microprocessor-type controller is configured to close the valve in the fluid supply line and open the bleed line to drain a portion of the plating bath from the plating cell.

17. The electrochemical plating apparatus of claim 9, wherein the microprocessor-type controller is configured to drain a portion of the plating bath from the plating cell during non-processing time periods by opening a selectively actuated bleed valve positioned in the bleed line.

* * * * *

UNITED STATES PATENT AND TRADEMARK OFFICE

CERTIFICATE OF CORRECTION

PATENT NO. : 6,878,245 B2
APPLICATION NO. : 10/085338
DATED : April 12, 2005
INVENTOR(S) : Srinivas Gandikota et al.

It is certified that error appears in the above-identified patent and that said Letters Patent is hereby corrected as shown below:

The title page should be deleted and substitute therefore the attached title page.

Drawings:

Delete drawings sheets 2-6, and substitute therefore the drawing sheets, consisting of Figs. 2-6 as shown on the attached pages.

Signed and Sealed this

Tenth Day of October, 2006

JON W. DUDAS
*Director of the United States Patent and Trademark Office*

US006878245B2

(12) United States Patent
Gandikota et al.

(10) Patent No.: US 6,878,245 B2
(45) Date of Patent: Apr. 12, 2005

(54) METHOD AND APPARATUS FOR REDUCING ORGANIC DEPLETION DURING NON-PROCESSING TIME PERIODS

(75) Inventors: Srinivas Gandikota, Santa Clara, CA (US); Chris R. McGuirk, San Jose, CA (US); Deenesh Padhi, San Jose, CA (US); Sivakami Ramanathan, Fremont, CA (US); Muhammad Atif Malik, Santa Clara, CA (US); Girish A. Dixit, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/085,338

(22) Filed: Feb. 27, 2002

(65) Prior Publication Data

US 2003/0159936 A1 Aug. 28, 2003

(51) Int. Cl.[7] ..... C25D 17/00; C25D 21/00

(52) U.S. Cl. ..... 204/275.1; 204/224 R; 204/237; 205/101; 205/148

(58) Field of Search ..... 204/237, 238, 204/245, 263, 264, 275.1, 276; 205/99, 101, 123, 148

(56) References Cited

U.S. PATENT DOCUMENTS

| | | | |
|---|---|---|---|
| 4,051,001 A | 9/1977 | Inoue et al. | 204/151 |
| 4,132,605 A | 1/1979 | Tench et al. | 204/1 T |
| 4,290,856 A | 9/1981 | Inoue | 204/4 |

(Continued)

OTHER PUBLICATIONS

F. A. Lowenheim, Electroplating, McGraw–Hill Book Company, New York, 1978, pp. 152–155.*

*Primary Examiner*—Roy King
*Assistant Examiner*—William T. Leader
(74) *Attorney, Agent, or Firm*—Moser, Patterson & Sheridan

(57) ABSTRACT

Embodiments of the invention generally provide an apparatus and method for replenishing organic molecules in an electroplating bath. The replenishment process of the present invention may occur on a real-time basis, and therefore, the concentration of organics minimally varies from desired concentration levels. The replenishment method generally includes conducting pre-processing depletion measurements in order to determine organic depletion rates per current density applied in the electroplating system. Once the organic depletion rates per current density are determined, these depletion rates may be applied to an electroplating processing recipe to calculate the volume of organic depletion per recipe step. The calculated volume of organic depletion per recipe step may then be used to determine the volume of organic molecule replenishment per unit of time that is required per recipe step in order to maintain a desired concentration of organics in the plating solution. The calculated replenishment volume may then be added to the processing recipe so that the replenishment process may occur at real-time during processing periods. The apparatus generally includes a selectively actuated valve in communicaiton with a fluid delivery line, wherein the valve is configured to fluidly isolate a plating cell during a non-processing time period. The valve may be controlled by a system controller, and thus, the fluid level in the cell may be controlled during a non-processing time period.

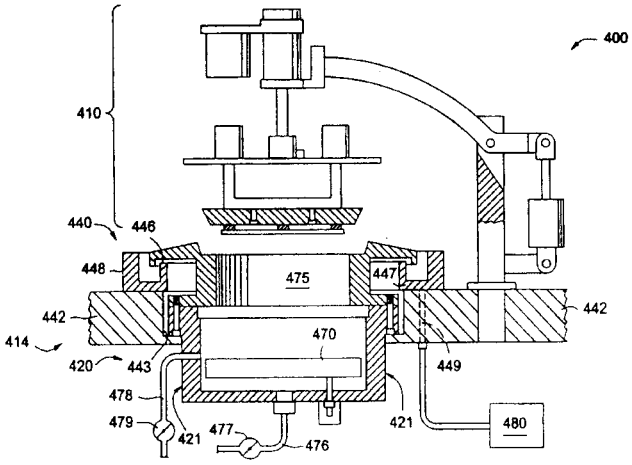

17 Claims, 7 Drawing Sheets